US008850620B1

(12) United States Patent
Carretero

(10) Patent No.: US 8,850,620 B1
(45) Date of Patent: Oct. 7, 2014

(54) PANT LEG LENGTH SHORTENING DEVICE

(76) Inventor: Yolanda Marie Carretero, Santa Rosa, CA (US)

( * ) Notice: Subject to any disclaimer, the term of this patent is extended or adjusted under 35 U.S.C. 154(b) by 557 days.

(21) Appl. No.: 13/068,971

(22) Filed: May 24, 2011

(51) Int. Cl.
*A41D 27/10* (2006.01)

(52) U.S. Cl.
USPC ..... 2/269

(58) Field of Classification Search
USPC ..... 2/269, 270, 312, 335, 336, 240, 242, 2/311, 75, 79, 227, 321, 911
See application file for complete search history.

(56) References Cited

U.S. PATENT DOCUMENTS 4,825,475 A * 5/1989 Smart ..... 2/312
5,214,805 A * 6/1993 Cochran ..... 2/232
D360,742 S * 8/1995 Wilkins ..... D2/624
6,158,057 A * 12/2000 Neumann ..... 2/312
6,374,414 B1 * 4/2002 Collier ..... 2/69
6,393,619 B1 * 5/2002 Bardes ..... 2/232
7,574,753 B1 * 8/2009 Seyfried ..... 2/312

* cited by examiner

*Primary Examiner* — Tejash Patel
(74) *Attorney, Agent, or Firm* — Risto A. Rinne, Jr.

(57) ABSTRACT

A device and method for shortening the appearance of a pant leg includes an elastic band with a fabric covering. On opposite ends of the band are a main hook and a main loop. The main hook and main loop provide a means for securing the band around a leg of a user. An additional second loop provides a tighter fit. A plurality of small loops are provided along the band. A hooked decorative strip is attached to the loops on the band. Additionally, a hooked strand of decorative beads or charms can be individually attached to each of the loops on the band. After securing the band on the leg, the band is urged upward. A bulge of pant material is created above the band and the bulge is pulled downward over the band creating a shorter length of the pant leg.

19 Claims, 7 Drawing Sheets

PANT LEG LENGTH SHORTENING DEVICE

BACKGROUND OF THE INVENTION

1. Field of the Invention

The present invention, in general, relates to a pair of pants worn over a person's legs and, more particularly, to a device and method for a shortening of a length of a leg of the pair of pants in appearance.

Pants are a common type of clothing worn by men, women and children. Styles, lengths and materials vary depending on the preferred embodiment of the pair of pants.

At times, a person wearing pants (or long-length shorts) may wish to quickly adjust a bottom length of the garment to a shorter length. For example, if a person is at a beach and wishes to enter the water on the shore without getting a bottom of their pants wet, a quick method to shorten the bottom length of the pants that they are wearing would be desirable.

If the weather on a particular day is especially hot and the person has chosen to wear long pants, a solution to quickly convert the pants into a shorter and, therefore, cooler length would also be desirable.

Other times, the person wearing pants may wish to promote a fashionable appearance of the pants by shortening the length of the pant legs. By shortening the length of the pants, a new style option is achieved for the same pair of pants. This allows the person to cost-effectively create several different looks from one single pair of pants.

Shorter pants known as "Capri" or "Gaucho" pants usually include a pant leg length that ends at about a mid-calf location on a leg of a wearer of the pants. However, Capri or Gaucho pants cannot be lengthened to cover an entire leg portion of the wearer, as the material is cut to the preferred mid-calf location. Also, the Capri pant does not include any excess material to be extended lower down the leg of the wearer, and in turn, makes the short length of the pant permanent. The wearer is therefore not able to convert the shorter length of the pant into a longer length, if desired.

A common practice to provide a shorter length of a pair of pants is by sewing. This process involves a removal of existing hem stitches already present on the pair of pants. A bottom hem stitch of the pants is removed to allow a new hem stitch to be sewn at a preferred shorter length location.

The pants are turned inside out and a bottom end of the pant leg is raised along an inside of the pant leg to the preferred shorter length location. Once the bottom end of the pant is at the preferred shorter length location, the bottom end is pinned in place. The new hem is created by sewing a cuff (i.e., bottom end of the pant) to the inside of the pant leg with a needle and thread.

Unless the person attempting to shorten the pants is skilled at sewing, the result of the shortening attempt may be less than desirable in appearance and potentially uneven in length.

Another method of shortening the pant leg length is to apply an adhesive tape. The pants are turned inside out and the bottom end of the pant leg is raised up to the preferred shorter length location. The adhesive tape is applied on the inside of the pant leg.

To apply the adhesive tape, a lower portion of the adhesive tape is applied around an entire interior circumference of the bottom end or cuff of the pant. An upper portion of the adhesive tape is applied to the inside fabric material of the pant leg.

To secure the adhesive tape, an iron is used to apply heat and pressure over the adhesive tape after it has been applied. The iron is applied over the adhesive tape along the interior circumference of the pant leg. Heat from the iron penetrating through the tape reaches an adhesive surface on the back of the tape and melts the adhesive into the fabric material of the pants.

After the adhesive has cooled, a bond is created between the adhesive tape and the fabric material that retains the bottom end or cuff of the pant at the preferred shorter length location on the inside of the pant leg.

Both of the above methods for sewing and applying the adhesive tape are time consuming and permanent. Once the pants have been shortened using these methods, removal of the adhesive tape or sewn on stitches is difficult and may result in damage to the fabric material of the pants.

In addition, if the fabric material has been cut to provide the shorter length, the pant leg length is no longer variable. The pants now include a length that is fixed in position and cannot be returned to the previous longer length, if desired.

A quick and non-permanent solution to shorten the length of the pant leg is to use pins. The pants are again turned inside out and the bottom end or cuff is raised to the preferred shorter pant leg length location. A plurality of pins or safety pins are inserted along the interior circumference of the pant leg.

Unfortunately using this method to secure the bottom end of the pant leg to the inside of the pant provides an unsightly appearance. A portion of a metal rod of the pin or safety pin can be seen (i.e., is visible) on an exterior of the pant leg.

Another problem with this method is that the person wearing the pants that have been shortened by use of pins may potentially be stabbed or injured. If one of the safety pins becomes loosened from its secured position or an exposed tip of the pin makes contact with a leg of the wearer, a potential for injury arises.

Accordingly, there exists today a need for a pant leg length shortening device and method that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such a device and method for shortening a length of a pant would be useful and desirable.

2. Description of Prior Art

Devices to shorten a length of a garment are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 7,748,058 to Steitle, that issued on Jul. 6, 2010;

U.S. Pat. No. 6,408,438 to Mc Kee, that issued on Jun. 25, 2002;

U.S. Pat. No. 5,214,805 to Cochran, that issued on Jun. 1, 1993;

U.S. Pat. No. 5,173,965 to Panner, that issued on Dec. 29, 1992;

U.S. Pat. No. 4,825,475 to Smart, that issued on May 2, 1989;

U.S. Pat. No. 3,411,160 to Le Roux, et al., that issued on Nov. 19, 1968;

U.S. Pat. No. 3,137,863 to Dimpfl, that issued on Jun. 23, 1964;

U.S. Pat. No. 2,962,726 to Wehrli, that issued on Dec. 6, 1960;

U.S. Pat. No. 2,962,724 to Wilkens, that issued on Dec. 6, 1960;

U.S. Pat. No. 2,869,138 to Hankoff, that issued on Jan. 20, 1959;

U.S. Pat. No. 2,596,112 to Aines, that issued on May 13, 1952;

U.S. Pat. No. 2,525,756 to Aines, that issued on Oct. 17, 1950;

U.S. Pat. No. 2,480,276 to Wilkenfeld, that issued on Aug. 30, 1949;

U.S. Pat. No. 2,247,601 to Buhrle, that issued on Jul. 1, 1941;

U.S. Pat. No. 1,815,702 to Cahn, that issued on Jul. 21, 1931;

U.S. Pat. No. 1,682,450 to Wanninger, et al., that issued on Aug. 28, 1928;

U.S. Pat. No. 1,567,460 to Parsons, that issued on Dec. 29, 1925;

U.S. Pat. No. 1,548,574 to Ade, that issued on Aug. 4, 1925; and

U.S. Pat. No. 1,106,375 to Grean, that issued on Aug. 11, 1914, and including Design patents:

U.S. Design Pat. No. D590,568 to Crutchfield, that issued on Apr. 14, 2009;

U.S. Design Pat. No. D494,737 to Schaefer, that issued on Aug. 24, 2004; and

U.S. Design Pat. No. D360,742 to Wilkins, that issued on Aug. 1, 1995, and including U.S. Patent Application Publications:

U.S. Patent Application Publication No. 2007/0271683 to McCrary, et al., that published on Nov. 29, 2007.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a pant leg length shortening device and method that includes an elastic band.

It is also an important object of the invention to provide a pant leg length shortening device and method that includes a fabric covering.

Another object of the invention is to provide a pant leg length shortening device and method that includes a fabric covering disposed over an elastic band.

Still another object of the invention is to provide a pant leg length shortening device and method that includes a fabric covering that is pleated.

Still yet another object of the invention is to provide a pant leg length shortening device and method that includes a fabric covering that is flexible.

Yet another important object of the invention is to provide a pant leg length shortening device and method that includes an elastic band with a fabric covering that can stretch or contract to accommodate a variety of leg circumference sizes.

Still yet another important object of the invention is to provide a pant leg length shortening device and method that includes an elastic band with a fabric covering that includes a plurality of spaced-apart loops attached along a longitudinal length of the elastic band.

A first continuing object of the invention is to provide a pant leg length shortening device and method that includes a hook attached to a strand of decorative beads and a loop attached to the pant leg length shortening device as a means for securing the decorative beads to the pant leg length shortening device.

A second continuing object of the invention is to provide a pant leg length shortening device and method that includes a plurality of hooks and a plurality of loops as a means for securing a decorative strip to the pant leg length shortening device.

A third continuing object of the invention is to provide a pant leg length shortening device and method that includes any preferred type of a means for securing.

A fourth continuing object of the invention is to provide a pant leg length shortening device and method that is easy to use.

A fifth continuing object of the invention is to provide a pant leg length shortening device and method that is removable.

A sixth continuing object of the invention is to provide a pant leg length shortening device and method that allows a user to quickly and easily adjust a length of the pant leg of a pair of pants to any preferred shorter length.

A seventh continuing object of the invention is to provide a pant leg length shortening device and method that is worn over the pant leg of a pair of pants.

An eighth continuing object of the invention is to provide a pant leg length shortening device and method that does not damage a material consisting of the pant leg.

A ninth continuing object of the invention is to provide a pant leg length shortening device and method that includes an optional decorative fabric strip.

A tenth continuing object of the invention is to provide a pant leg length shortening device and method that includes an optional decorative fabric strip wherein the decorative fabric strip includes a color that accentuates anything worn by a user.

An eleventh continuing object of the invention is to provide a pant leg length shortening device and method that includes an optional decorative fabric strip that is made from a wide variety of materials.

A twelfth continuing object of the invention is to provide a pant leg length shortening device and method that includes an optional set of decorative beads.

A thirteenth continuing object of the invention is to provide a pant leg length shortening device and method that includes an optional set of decorative charms.

A fourteenth continuing object of the invention is to provide a pant leg length shortening device and method that includes an optional decorative fabric strip that includes a plurality of hooks for attachment.

A fifteenth continuing object of the invention is to provide a pant leg length shortening device and method that includes an optional set of decorative beads that each include a hook for attachment.

A sixteenth continuing object of the invention is to provide a pant leg length shortening device and method that includes an optional set of charms that each include a hook for attachment.

A seventeenth continuing object of the invention is to provide a pant leg length shortening device and method that is available for purchase as a pair of devices.

An eighteenth continuing object of the invention is to provide a pant leg length shortening device and method that provides a shorter appearance for the pant leg.

Briefly, a pant leg length shortening device and method that is constructed in accordance with the principles of the present invention has an inner elastic band that is disposed within a decorative pleated fabric covering. The elastic band is flexible. The elastic band preferably includes a length that would accommodate placement over a calf portion of a leg of a user. The elastic band includes a main hook located on a first end thereof and a main loop located on an opposite second end thereof. The main hook is inserted into the main loop to provide a means for securing the elastic band around a circumference of the calf of the user. An additional second loop may be provided on an exterior portion of the pleated fabric covering of the elastic band proximate the main loop. If desired, the main hook is inserted in the second loop to provide a tighter fit of the elastic band around the circumference of the leg. Preferably, a plurality of spaced-apart small loops are provided along an entire longitudinal length of the elastic band. The small loops are attached through the pleated fabric covering and the elastic band at a lower portion, thereof. The plurality of small loops are used to secure a decorative strip to the elastic band. The decorative strip includes a plurality of spaced-apart small hooks that are attached to the small loops located on the lower portion of the elastic band. The decorative strip may include any preferred material or color. The decorative strip includes a length that is slightly longer than the length of the elastic band. The longer length of the decorative strip allows for an overlap of material of the decorative strip. The overlap is provided in order to prevent a gap (i.e., space) from being present between each end of the decorative strip. If preferred, each of the small loops on the elastic band may be used to secure an individual strand of decorative beads or charms. The strand of decorative beads or charms includes an upper hook located at an upper portion, thereof. The upper hook is used to secure the individual strand of beads or charms to the small loops located on the elastic band. If desired, the user secures the decorative strip or decorative beads (or charms) to the elastic band prior to placement of the elastic band onto their leg. To use the pant leg length securing device, the user puts on a pair of pants in a normal conventional manner. The pant leg length shortening device is then placed on an exterior surface of the pant leg at a location proximate the user's ankle. The pant leg length shortening device is secured around the circumference of the leg by inserting the main hook into the main loop provided on the end of the pant leg length shortening device. The main hook may also be inserted into the second loop located on the exterior of the pleated fabric covering disposed over the elastic band to provide the tighter fit. The pant leg length shortening device is then urged in an upward direction by grasping the pant leg material above the pant leg length shortening device and raising both the pant leg and the pant leg length shortening device upward along the leg until reaching a desired position along the calf portion of the leg. If desired, the pant leg length shortening device may be placed at any location along the leg of the user. A lower portion of the pant leg material that is disposed under the elastic band is also raised upward during the raising of the pant leg length shortening device. An excess of pant material (i.e., bulge) is then formed above the elastic band. The bulge is grasped on either side thereof and is urged in a downward direction until a lower end of the bulge is disposed slightly lower than the elastic band. The elastic band is not visible once the bulge has been urged downward. The lower end of the bulge is manually creased to form a new lower edge of the pant leg. A shorter style (i.e., Capri style) is then achieved for the pant leg. An original bottom end of the pant leg (i.e., cuff) remains under the elastic band in a raised position on the leg. Tension provided by the elastic band securely holds the bottom end of the pant leg in the raised position. If used, the decorative strip, beads or charms are attached to the pant leg length shortening device before it is raised and remain visible below the lower edge of the pant. The process is repeated with an additional pant leg length shortening device on an opposite leg of the user. To remove the pant leg length shortening device, the user lifts up the excess pant material to expose the pant leg length shortening device. The user then simply unhooks the main hook from the main loop (or second loop) and the pant leg returns to a normal full length along the leg of the user.

DETAILED DESCRIPTION OF THE INVENTION

Figure 1:
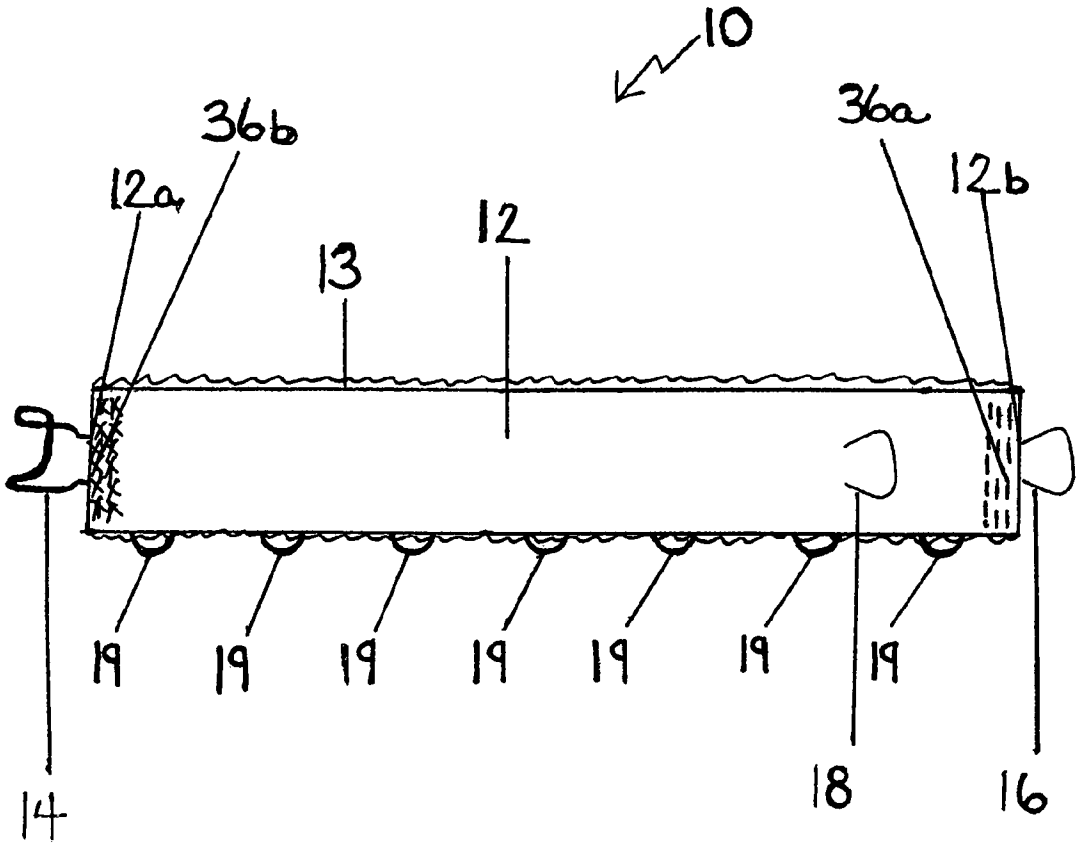
FIG. 1 is a plan view of a pant leg length shortening device.

Referring on occasion to all of the FIGURE drawings and now, in particular to FIG. 1, is shown a pant leg length shortening device, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

The pant leg length shortening device 10 includes an inner elastic band 12. The elastic band 12 is formed of a flexible elastic material.

Disposed over an exterior of the elastic band 12 is a decorative pleated fabric covering 13, which completely surrounds the inner elastic band 12. The pleated fabric covering 13 includes any preferred flexible material. The pleated fabric covering 13 may also include any preferred color.

The elastic band 12 includes a main hook 14 located on a first end 12*a* of the elastic band 12. The main hook 14 is formed of either metal, plastic or any other preferred material and is attached to the elastic band 12.

A main loop 16 is provided on an opposite second end 12*b* of the elastic band 12. The main loop 16 is also formed of either metal, plastic or any other preferred material and is attached to the elastic band 12. The main hook 14 is inserted into the main loop 16 to provide a means for securing the elastic band 12 in a circular orientation.

An additional second loop 18 is located proximate the second end 12*b* and is attached to the pleated fabric covering 13 or to the elastic band 12. The second loop 18 is used to provide a tighter fit around a circumference of a calf portion of a leg 22 (See FIG. 2) of a user. The second loop 18 is formed of the same material used for the main hook 14 and main loop 16, typically either a plastic or light gauge metal.

A plurality of spaced-apart small loops 19 are provided along an entire longitudinal length of the elastic band 12. The small loops 19 are disposed at a lower portion of the elastic band 12. The small loops 19 are attached through the pleated fabric covering 13 and the elastic band 12. Use of the small loops 19 are described in greater detail, hereinafter.

Figure 2:
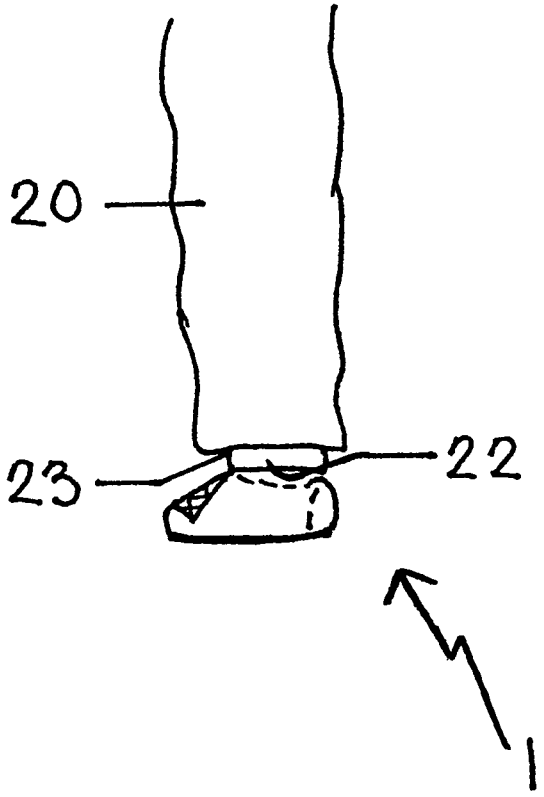
FIG. 2 is a view in perspective of a pant leg shown in a first position or normal position absent the pant leg length shortening device.

Now referring to FIG. 2, is shown a completion of a first step 1 of a method for shortening the length of a pant leg using the pant leg length shortening device 10. A portion of a pant leg 20 is shown disposed over the leg 22 of the user. The pant leg 20 is in a normal, fully extended position that extends down an entire length of the leg 22.

A lower cuff 23 of the pant leg 20 is located proximate an ankle (not shown) on the leg 22.

Figure 3:
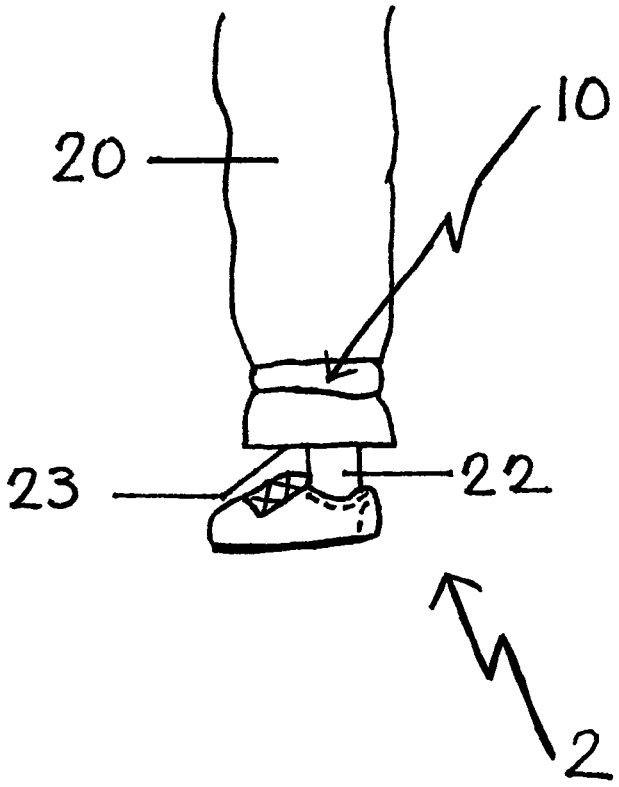
FIG. 3 is a view in perspective of the pant leg length shortening device of FIG. 1 shown in a second position.

Now referring to FIG. 3, is shown a completion of a second step 2 of a method for shortening the length of a pant leg using the pant leg length shortening device 10. The pant leg length shortening device 10 (i.e., elastic band 12) has been placed over an exterior of the pant leg 20. The pant leg length shortening device 10 is placed proximate the lower cuff 23 of the pant leg 20.

The elastic band 12 stretches around the circumference of the leg 22. The elastic band 12 is secured in place by inserting the main hook 14 into the main loop 16 (or if preferred, the second loop 18). Tension provided by an elastic force of the elastic band 12 compresses, and thereby secures, the pant leg 20 around the leg 22.

The user then grasps a portion of the pant leg 20 that is disposed above the pant leg length shortening device 10 and urges the pant leg 20 in an upward direction sufficient to pull (i.e., raise) the pant leg 20 and pant leg length shortening device 10 simultaneously up over the calf of the leg 22 a desired amount.

Figure 4:
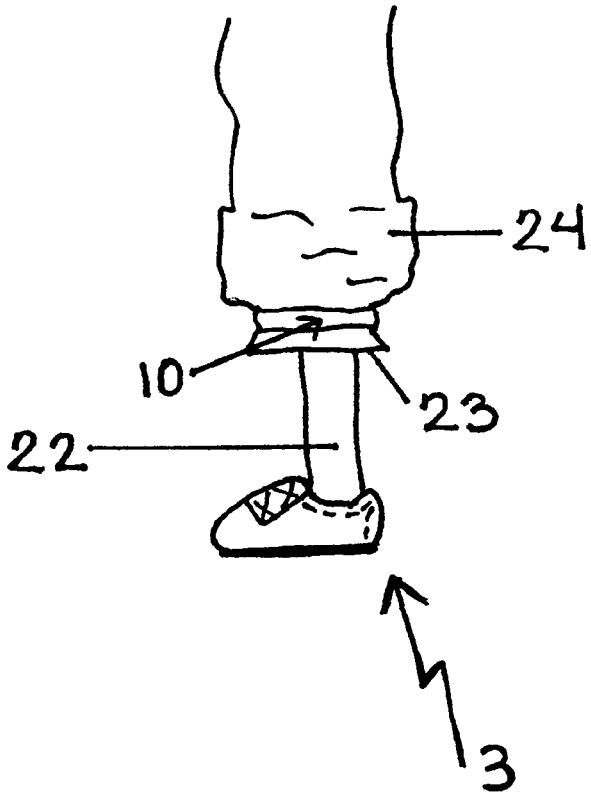
FIG. 4 is a view in perspective of the pant leg length shortening device of FIG. 1 shown in a third position.

Now referring to FIG. 4, is shown a completion of a third step 3 of a method for shortening the length of a pant leg using the pant leg length shortening device 10. A bulge 24 (i.e., an excess of material of the pant leg 20) has formed above the pant leg length shortening device 10. The bulge 24 is grasped by the user on a left and an opposite right side, thereof (i.e., around a circumference of the pant leg) and the bulge 24 is urged in a downward direction over the pant leg length shortening device 10 and over the lower cuff 23.

Figure 5:
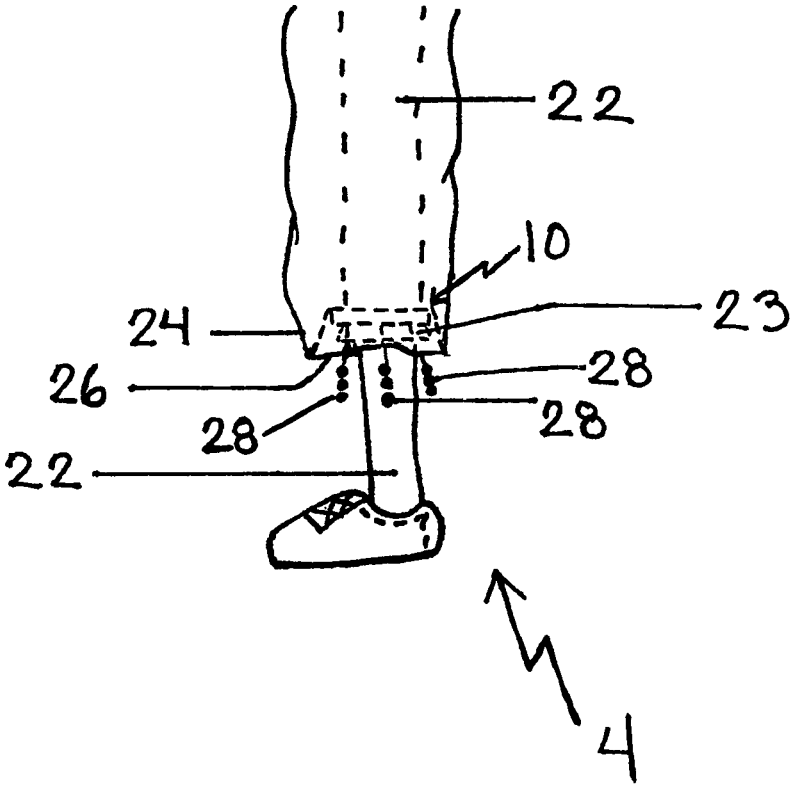
FIG. 5 is a view in perspective of the pant leg length shortening device of FIG. 1 shown in a fourth position.

Now referring to FIG. 5, is shown a completion of a fourth step 4. The bulge 24 has been urged downward over the elastic band 12 and lower cuff 23 of the pant leg 20. The pant leg length shortening device 10 and the lower cuff 23 of the pant leg 20 are obscured from view by the lower portions of the pant leg 20. By gently tugging all around a lower portion of the bulge 24, a modified upper cuff 26 is formed around the leg 22. Accordingly, the bulge 24 is no longer present. The modified upper cuff 26 is formed approximately at a middle of the excess pant leg 20 material that previously formed the bulge 24.

The upper cuff 26 is disposed lower than the pant leg length shortening device 10 and lower than the lower cuff 23 of the pant leg 20, thus hiding both of them from view.

The pant leg 20 appears to have a finished-looking shorter length than it actually does. In this way, any desired pair of pants can be made to appear to have a shorter pant leg 20 length than they actually do. Additionally, the degree of apparent shortening is a variable that can be changed at any time to create an even shorter or slightly longer appearance for the pant leg 20.

This process is repeated with an additional pant leg length shortening device 10 placed on an opposite leg 22 of the user (not shown).

Figure 6:
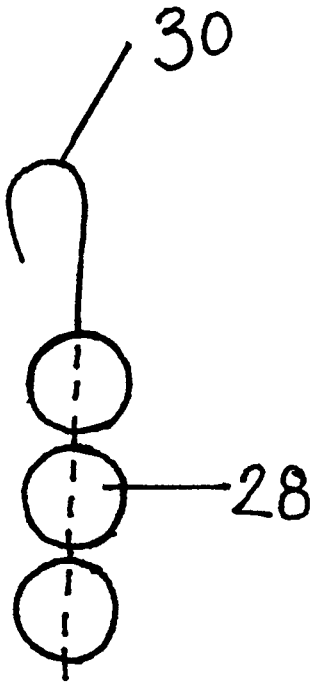
FIG. 6 is a plan view of a strand of decorative beads which can optionally be included with the pant leg length shortening device of FIG. 1.

Referring now to FIG. 6 (and FIG. 5), a strand of decorative beads 28 includes a small upper hook 30 at an upper end, thereof. Any desired type of ornamentation (other than beads) can be used for the decorative beads 28. For example, they can include charms or decorations of any type. Ideally, the decorative beads 28 are chosen to provide an accent color that helps the user better coordinate the various clothing, jewelry, and accessory items that they may be wearing.

It is important to note that different color or style of the decorative beads 28 can be used with the pant leg length shortening device 10 to optimally coordinate and accentuate the appearance of any color or style of the pant leg 20 or jewelry that the user may be wearing.

The upper hook 30 of each of a plurality of the strands of decorative beads 28 are placed in each of the small loops 19 along the length of the elastic band 12.

The upper hook 30 is used to secure the decorative beads 28 in position with respect to the small loop 19. A portion of the decorative beads 28 extend down from the pant leg length shortening device 10 and beyond (i.e., lower than) the upper cuff 26 (See FIG. 5). Therefore, the portion of the decorative beads 28 that extend below the upper cuff 26 are visible and help coordinate or accentuate with any aspect of an outfit that the user is wearing.

The decorative beads 28 are affixed to the small loops 19 at any preferred time prior to a lowering of the bulge 24. Therefore, the decorative beads 28 may be attached after completion of the second step 2 as shown in FIG. 3, or after completion of the third step 3 as shown in FIG. 4.

Additionally, the decorative beads 28 may be inserted onto the small loops 19 prior to the elastic band 12 being secured over the pant leg 20.

Figure 7:
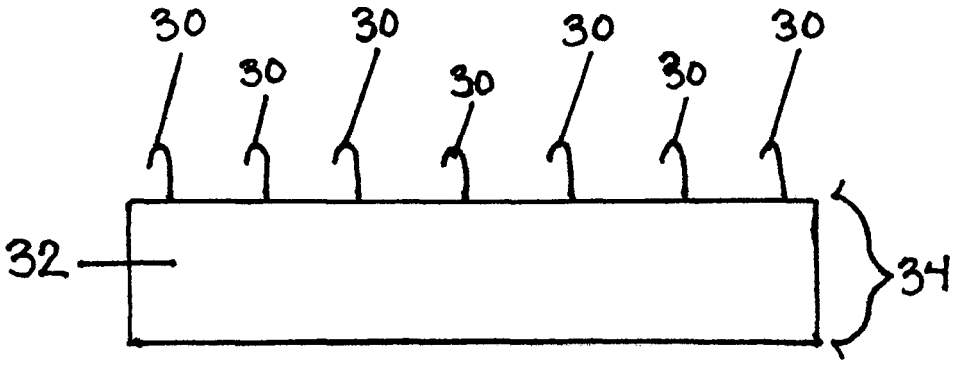
FIG. 7 is a plan view of a decorative strip which can optionally be included with the pant leg length shortening device of FIG. 1.

Referring now to FIG. 7, a decorative strip 32 is provided with a plurality of the small upper hooks 30 attached along an upper end, thereof. The decorative strip 32 can include any desired fabric material or any desired color. The decorative strip 32 can also be formed of a lace-type of material.

A longitudinal length of the decorative strip 32 is slightly longer than the longitudinal length of the elastic band 12. The longer length of the decorative strip 32 allows for an overlap of material of the decorative strip 32 once the decorative strip 32 is attached to the small loops 19. The overlap is provided in order to prevent a gap (i.e., space) from being present between each end of the decorative strip 32. This ensures that the decorative strip 32, when attached to the pant leg length shortening device 10, will wrap and extend fully around the leg 22 of the user. If the decorative strip 32 includes lace material (of any color), the lace material is also used to better coordinate or accentuate the accoutrement of the user.

A height of the decorative strip 32, as shown by bracket 34, is approximately equal to a longitudinal length (i.e., height) of the decorative beads 28. This is to ensure that at least some of the decorative strip 32 will extend down below the upper cuff 26 and be visible to others. The decorative strip 32 provides a band of color (any preferred color, color combination or pattern) to better coordinate or accentuate anything worn by the user.

An unexpected benefit is provided by the pant leg length shortening device 10, as the user is able to cost-effectively create several different looks from one single pair of pants. By shortening the length of each of the pant legs 20, a new style option is achieved for the same pair of pants.

The decorative beads 28 and the decorative strip 32 also provide a second unexpected benefit. Multiple style accent options are afforded to the same pair of pants by the inclusion of the decorative beads 28 and decorative strip 32. The user can enhance an appearance of the same pair of pants by selecting any preferred color or type of decorative bead 28 as well as any preferred color or type of material for the decorative strip 32 to accentuate the overall appearance of the user.

Other changes are, of course, possible. For example, longer (or shorter) decorative beads 28 could be used as well as different styles, colors, shapes of the decorative beads 28 could be used on the same pant leg length shortening device 10 at any given time. And, as mentioned, the decorative beads 28 can include charms or any other preferred ornamentation.

Other materials and other changes are equally possible for the decorative strip 32. For example, leather (or any desired material) could be used for the decorative strip 32 to better match with any clothing, shoe, or accessory item that the user may be wearing.

Referring again to FIG. 1, if desired, the main hook 14, main loop 16, and second loop 18 can be eliminated and a hook and loop fastener 36*a*, 36*b*, can be used to secure the first end 12*a* and the second end 12*b* of the elastic band 12 together. The hook and loop fastener 36*a*, 36*b* portions are on opposite ends and on opposite sides of the pant leg length shortening device 10.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for shortening an appearance of a pant leg of a pair of pants that is worn over a leg of a person using a pant leg length shortening device, comprised of the steps of:

(a) placing the pant leg over the leg of the person;

(b) placing the pant leg length shortening device over a lower portion of the pant leg, wherein the pant leg length shortening device includes an elastic material that has a predetermined longitudinal length when said elastic material is disposed in a quiescent non-extended state, and wherein when the pant leg length shortening device is disposed over said lower portion of the pant leg said elastic material is disposed in an extended state, and wherein an effective longitudinal length of said elastic material is greater in said extended state than in said quiescent state, and wherein when said elastic material is disposed in said extended state, said elastic material exerts a force upon the pant leg that urges the pant leg into contact with the leg of the person sufficient to retain the pant leg at a desired position along a longitudinal length of the leg of the person;

(c) urging the pant leg and the pant leg length shortening device upward along said longitudinal length of the leg a predetermined amount, wherein said predetermined amount is sufficient to provide a bulge in the pant leg; and (d) grasping a circumference of said bulge and urging said bulge in a downward direction over the pant leg length shortening device a sufficient amount to cover the pant leg length shortening device to prevent viewing of the pant leg length shortening device and over said lower portion of the pant leg.

2. The method of claim 1 wherein the step of urging the pant leg and the pant leg length shortening device upward along said longitudinal length of the leg a predetermined amount includes the step of grasping the pant leg above the pant leg length shortening device and simultaneously urging the pant leg and the pant leg length shortening device upward said predetermined amount.

3. The method of claim 1 wherein the step of placing the pant leg length shortening device over said lower portion of the pant leg includes the step of securing a first end of the pant leg length shortening device proximate an opposite second end of the pant leg length shortening device includes securing a hook that is disposed at said first end to a main loop that is disposed at said second end.

4. The method of claim 1 wherein the step of placing the pant leg length shortening device over said lower portion of the pant leg includes the step of securing a first end of the pant leg length shortening device proximate an opposite second end of the pant leg length shortening device includes securing a first portion of a hook and loop fastener that is disposed at said first end to a second portion of a hook and loop fastener that is disposed at said second end.

5. The method of claim 1 wherein the step of grasping a circumference of said bulge and urging said bulge in a downward direction includes the step of forming a modified cuff at a bottom of the pant leg.

6. The method of claim 1 including the step of attaching a charm or a bead or a plurality of charms or a plurality of beads to the pant leg length shortening device prior to the step of grasping a circumference of said bulge and urging said bulge in a downward direction.

7. The method of claim 1 including the step of attaching a decorative strip to said pant leg length shortening device prior to the step of grasping a circumference of said bulge and urging said bulge in a downward direction.

8. A pant leg length shortening device for shortening an appearance of a pant leg, comprising:

(a) an elastic material that has a first end and an opposite second end and a first longitudinal length when said elastic material is disposed in a quiescent non-extended state and a second longitudinal length when said elastic material is disposed in an extended state, and wherein said second longitudinal length is greater than said first longitudinal length;

(b) means for detachably-securing said first end proximate said second end; and (c) a plurality of loops attached to said elastic material along a longitudinal length thereof;

wherein during use the pant leg length shortening device is covered by a portion of a pant leg and is not visible, and wherein said plurality of loops are disposed along a lower perimeter of the pant leg length shortening device, and wherein the pant leg length shortening device includes at least one ornamentation attached, thereto, and wherein said ornamentation includes a longitudinal length and a first ornament end and an opposite second ornament end, and wherein said first ornament end includes a hook, and wherein said hook is able to engage with one of said plurality of loops sufficient to retain said ornamentation proximate the pant leg length shortening device, and wherein said ornamentation is disposed below the pant leg length shortening device and wherein at least a portion of said ornamentation is visible during use of the pant leg length shortening device.

9. The pant leg length shortening device of claim 8 including a fabric covering that is disposed over said elastic material.

10. The pant leg length shortening device of claim 9 wherein said fabric covering includes a pleated fabric.

11. The pant leg length shortening device of claim 8 wherein said ornamentation includes a bead or a charm.

12. The pant leg length shortening device of claim 8 wherein said ornamentation includes a strand of beads or a strand of charms and wherein said strand of beads includes a plurality of beads and wherein said strand of charms includes a plurality of charms.

13. The pant leg length shortening device of claim 12 wherein said ornamentation includes a plurality of strands of beads or a plurality of strands of charms and wherein each of said plurality of strands of beads or each of said plurality of strands of charms is secured to one of said plurality of loops by said hook.

14. The pant leg length shortening device of claim 8 wherein said ornamentation includes a decorative strip and wherein said decorative strip includes a plurality of hooks and wherein each of said plurality of hooks is able to engage with one of said plurality of loops.

15. The pant leg length shortening device of claim 14 wherein said decorative strip includes a fabric material, and wherein said fabric material includes a longitudinal length, and wherein said longitudinal length of said fabric material is equal to or greater than said second longitudinal length.

16. The pant leg length shortening device of claim 15 wherein said fabric material includes a predetermined color or pattern.

17. The pant leg length shortening device of claim 15 wherein said fabric material includes a lace material.

18. The pant leg length shortening device of claim 8 wherein said means for detachably-securing said first end proximate said second end includes a hook that is disposed at said first end and a main loop that is disposed at said second end, and wherein said hook is able to engage with said main loop.

19. The pant leg length shortening device of claim 8 wherein said means for detachably-securing said first end proximate to said second end includes a first portion of a hook and loop fastener that is attached to said first end and a second portion of a hook and loop fastener that is attached to said second end.

* * * * *